US010301825B1

(12) United States Patent
Uncapher

(10) Patent No.: US 10,301,825 B1
(45) Date of Patent: May 28, 2019

(54) REBAR HOLSTER SYSTEM

(71) Applicant: Jason G. Uncapher, Sevierville, TN (US)

(72) Inventor: Jason G. Uncapher, Sevierville, TN (US)

( * ) Notice: Subject to any disclaimer, the term of this patent is extended or adjusted under 35 U.S.C. 154(b) by 0 days.

(21) Appl. No.: 15/977,107

(22) Filed: May 11, 2018

Related U.S. Application Data

(60) Provisional application No. 62/591,425, filed on Nov. 28, 2017.

(51) Int. Cl.
*E04B 2/54* (2006.01)
*E04C 5/16* (2006.01)

(52) U.S. Cl.
CPC ..... *E04C 5/163* (2013.01); *E04B 2/54* (2013.01); *E04C 5/166* (2013.01); *E04B 2103/02* (2013.01)

(58) Field of Classification Search
CPC ..... E04C 5/168; E04C 5/167; E04C 5/163; E04B 2/54
See application file for complete search history.

(56) References Cited

U.S. PATENT DOCUMENTS 2,453,466 A * 11/1948 Slobodzian ..... E04B 2/26 52/307
2,523,785 A * 9/1950 Sereno ..... A63H 33/102 248/229.26
2,571,337 A * 10/1951 Burnham ..... E02B 3/068 405/218
3,338,605 A * 8/1967 Stoeber ..... A47B 96/14 211/188
3,390,905 A * 7/1968 Stewart ..... E04B 1/21 403/161
4,002,349 A * 1/1977 Dopp ..... A63C 11/021 280/809
4,110,951 A * 9/1978 Padrun ..... E04C 5/168 403/395
4,617,775 A * 10/1986 Padrun ..... E04C 5/163 24/545
4,692,052 A * 9/1987 Yee ..... E04C 5/163 403/13
D298,739 S * 11/1988 Richards, Jr. ..... D22/110
5,152,118 A 10/1992 Lancelot
5,159,774 A * 11/1992 Bennis ..... A01K 93/02 24/339
5,288,047 A * 2/1994 Pan ..... F16L 3/237 248/229.26
D355,582 S * 2/1995 Sleight ..... D8/354
5,456,051 A * 10/1995 Queen ..... E04C 5/20 52/677

(Continued)

*Primary Examiner* — Paola Agudelo
(74) *Attorney, Agent, or Firm* — Luedeka Neely Group, P.C.

(57) ABSTRACT

A method of installing a vertical reinforcing bar in a masonry wall includes constructing a base portion of the masonry wall, positioning a vertical holster within the base portion, stacking concrete masonry units above the base portion to form a vertical core within the concrete masonry units that is aligned with the vertical holster, and lowering the vertical reinforcing bar through the vertical core and the opening of the upper portion of the vertical holster until the leading end of the vertical reinforcing bar is secured to securing means of the vertical holster.

11 Claims, 7 Drawing Sheets

(56) References Cited

U.S. PATENT DOCUMENTS

| | | | | | |
|---|---|---|---|---|---|
| 5,697,591 | A * | 12/1997 | Cooper | F21V 21/08 | 248/229.16 |
| 5,702,270 | A * | 12/1997 | Casica | H01R 13/72 | 24/339 |
| 6,141,937 | A * | 11/2000 | Dressler | E04C 5/163 | 52/298 |
| 6,161,360 | A * | 12/2000 | Smith | E04C 5/167 | 52/165 |
| 6,571,526 | B2 * | 6/2003 | Queen | E04C 5/166 | 52/431 |
| D510,857 | S * | 10/2005 | Minor | D8/354 | |
| D534,418 | S * | 1/2007 | Minor | D8/354 | |
| 7,377,083 | B2 | 5/2008 | McCafferty et al. | | |
| 7,448,179 | B2 | 11/2008 | Schieffer | | |
| 7,587,872 | B2 * | 9/2009 | Kodi | E04C 5/206 | 52/126.1 |
| 8,225,578 | B2 * | 7/2012 | Azizi Ronagh | E04B 2/16 | 52/285.2 |
| 9,394,692 | B2 | 7/2016 | Kodi | | |
| 2002/0112436 | A1 | 8/2002 | Sander et al. | | |
| 2004/0040247 | A1 | 3/2004 | Morse | | |
| 2006/0096231 | A1 | 5/2006 | Parish | | |
| 2008/0118304 | A1 * | 5/2008 | Carraher | B25H 3/04 | 403/396 |
| 2011/0047915 | A1 * | 3/2011 | Waters, Jr. | E04C 2/06 | 52/414 |
| 2016/0108620 | A1 | 4/2016 | Yi | | |
| 2017/0204608 | A1 | 7/2017 | Yang et al. | | |

* cited by examiner

REBAR HOLSTER SYSTEM

CROSS-REFERENCE TO RELATED APPLICATIONS

This application claims priority as a non-provisional to U.S. Provisional Application Ser. No. 62/591,425 filed Nov. 28, 2017, entitled "Rebar Holster System," the contents of which is incorporated herein by reference.

FIELD

This disclosure relates generally to a reinforcement system for concrete masonry walls. More particularly, this disclosure relates to a holster system that allows for vertical reinforcing bars to be secured within concrete masonry units prior to the pouring of grout within the units but after wall erection.

BACKGROUND

In constructing concrete masonry walls, concrete masonry units are generally stacked so that vertical cores are aligned to form an unobstructed, continuous series of vertical spaces within the wall. Head joints (i.e., vertical spaces between adjacent masonry units) and bed joints (i.e., horizontal spaces between adjacent masonry units) must be grouted to properly bond the units together. If the wall is partially grouted, the cross webs adjacent to the cores to be grouted are mortared to confine the grout flow. If the wall is solidly grouted, the cross webs need not be mortared since the grout flows laterally, filling all spaces.

In certain instances, full head joint mortaring should be considered when solid grouting since it is unlikely that grout will fill the space between head joints that are only mortared the width of the face shell (e.g., when penetration resistance is a concern such as tornado shelters and prison walls). In such cases, open end or open core units should be considered as there is no space between end webs with these types of units. Care should be taken to prevent excess mortar from extruding into the grout space. Mortar that projects more than ½ inches into the grout space must be removed. This is because large protrusions can restrict the flow of grout, which will tend to bridge at these locations, potentially causing incomplete filling of the grout space. To prevent bridging, grout slump is generally required to be between eight and eleven inches at the time of placement. This slump may be adjusted under certain conditions such as hot or cold weather installation, low absorption units or other project specific conditions. Approval should be obtained before adjusting the slump outside the requirements. Using the grout demonstration panel option in Specification for Masonry Structures is an excellent way to demonstrate the acceptability of an alternate grout slump.

At the footing (e.g., base portion of a wall), mortar bedding under the first course of block to be grouted should permit grout to come into direct contact with the foundation or bearing surface. If foundation/footer dowels are present, they should align with the cores of the masonry units. If a dowel interferes with the placement of the units, it may be bent a maximum of one inch horizontally for every six inches vertically. When walls will be solidly grouted, saw cutting or chipping away a portion of the web to better accommodate the dowel may also be acceptable. If there is a substantial dowel alignment problem, the project engineer must be notified.

In prior art systems, vertical reinforcing steel is typically placed into position before the masonry units are stacked. When vertical reinforcements are placed prior to laying block, the use of open-end "A" or "H" shaped units will allow the units to be placed around the reinforcing steel. It is required that both horizontal and vertical reinforcement be located within tolerances and secured to prevent displacement during grouting. Laps are made at the end of grout pours and any time the bar has to be spliced. Reinforcement can be spliced by either contact or noncontact splices. Noncontact lap splices may be spaced as far apart as one-fifth the required length of the lap but not more than eight inches per Building Code Requirements for Masonry Structures. This provision accommodates construction interference during installation as well as misplaced dowels. Splices are not required to be tied, however tying is often used as a means to hold bars in place.

As the wall is constructed, horizontal reinforcement can be placed in bond beam or lintel units. If the wall will not be solidly grouted, the grout may be confined within the desired grout area either by using solid bottom masonry bond beam units or by placing plastic or metal screening, expanded metal lath or other approved material in the horizontal bed joint before laying the mortar and units being used to construct the bond beam.

Using "A" or "H" block units to construct a wall with prior installed vertical reinforcements has several disadvantages. In particular, extra care must be taken to prevent excess mortar from extruding into the grout space due to the open ends of the "A" or "H" block units, "A" and "H" block units have a higher break rate due to their open ends, and laying "A" or "H" units after a reinforcement system has been put in place requires additional time in arranging the units correctly.

What is needed therefore is an efficient and effective system for providing vertical reinforcing bars after concrete masonry units have been positioned for constructing a concrete masonry wall. An efficient and effective system for coupling reinforcing bars together is also desired regardless of whether the bars are positioned pre-wall erection or post-wall erection.

SUMMARY

The present disclosure provides a method of installing a vertical reinforcing bar in a masonry wall, the method including constructing a base portion of the masonry wall; positioning a vertical holster within the base portion, the vertical holster comprising an upper portion having an opening dimensioned and configured for receiving a leading end of the vertical reinforcing bar and a lower portion having a securing means; stacking concrete masonry units above the base portion to form a vertical core within the concrete masonry units that is aligned with the vertical holster; and lowering the vertical reinforcing bar through the vertical core and the opening of the upper portion of the vertical holster until the leading end of the vertical reinforcing bar is secured to the securing means of the lower portion of the vertical holster.

According to certain embodiments, the securing means includes a friction engaging mechanism sufficient to hold the leading end of the vertical reinforcing bar in position within the vertical holster until grout is poured into the vertical core. In some embodiments, the friction engaging mechanism includes a washer formed of a resilient material, the washer including an aperture having a diameter substantially the same or smaller than a diameter of the leading end of the vertical reinforcing bar. In some embodiments, the washer includes an aperture having an upper portion with a first diameter and a lower portion with a second diameter, the first diameter being greater than the second diameter and at least the second diameter being substantially the same or smaller than a diameter of the leading end of the vertical reinforcing bar.

According to certain embodiments, the vertical holster includes a middle portion disposed between the upper portion and lower portion for guiding the leading end of the vertical reinforcing bar from the upper portion to the securing means of the lower portion. In some embodiments, the middle portion includes a diameter that is less than a diameter of the upper portion.

According to certain embodiment, the vertical holster includes an aperture extending from the upper portion to the securing means of the lower portion, the aperture including a first diameter adjacent the upper portion that is greater than a diameter of the leading end of the vertical reinforcing bar and a second diameter adjacent the lower portion that is substantially the same or smaller than a diameter of the leading end of the vertical reinforcing bar.

According to certain embodiments, the vertical holster includes an aperture extending from the upper portion to the securing means of the lower portion, the aperture having a diameter adjacent the upper portion that is greater than a diameter of the leading end of the vertical reinforcing bar.

According to certain embodiments, the positioning step includes positioning a combination holster within the base portion, the combination holster including the vertical holster and at least one horizontal holster adjacent the vertical holster, the method further comprising securing a horizontal reinforcing bar to the horizontal holster prior to stacking concrete masonry units above the base portion and lowering the vertical reinforcing bar through the vertical core formed by the stacked concrete masonry units. According to some embodiments, the step of positioning the vertical holster within the base portion of the masonry wall may also include securing the vertical holster to a footer dowel prior to stacking concrete masonry units above the base portion.

According to certain embodiments, the method further includes securing a combination holster to a trailing end of the vertical reinforcing bar, the combination holster including a second vertical holster for receiving the trailing end of the vertical reinforcing bar and at least one horizontal holster adjacent the second vertical holster; securing a horizontal reinforcing bar to the horizontal holster of the combination holster after stacking concrete masonry units above the base portion and lowering the vertical reinforcing bar through the vertical core formed by the stacked concrete masonry units; and pouring grout into the vertical core.

According to another embodiment of the disclosure, a rebar holster system includes a vertical holster configured to be positioned within a base portion of a masonry wall. The vertical holster includes an upper portion having an opening dimensioned and configured for receiving a leading end of the vertical reinforcing bar dropped down through a vertical core formed from stacking concrete masonry units above the base portion of the masonry wall. The opening includes a diameter that is greater than a diameter of the leading end of the vertical reinforcing bar. The vertical holster further includes a lower portion having a securing means for securing the leading end of the vertical reinforcing bar to the vertical holster and a middle portion disposed between the upper portion and the lower portion for guiding the leading end of the vertical reinforcing bar from the opening of the upper portion to the securing means of the lower portion.

According to certain embodiments, the securing means includes a friction engaging mechanism. In some embodiments, the friction engaging mechanism includes a washer formed of a resilient material, the washer including an aperture having a diameter substantially the same or smaller than the diameter of the leading end of the vertical reinforcing bar. In some embodiments, the washer includes an aperture having an upper portion with a first diameter and a lower portion with a second diameter, the first diameter being greater than the second diameter and at least the second diameter being substantially the same or smaller than the diameter of the leading end of the vertical reinforcing bar.

According to certain embodiments, the middle portion includes a diameter that is less than the diameter of the opening of the upper portion.

According to certain embodiments, the vertical holster is part of a combination holster that further includes at least one horizontal holster adjacent the vertical holster configured for receiving a horizontal reinforcing bar. In some embodiments, the vertical holster is part of a combination holster that further includes a second vertical holster for securing to a footer dowel prior to stacking concrete masonry units above the base portion of the masonry wall.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The present disclosure provides a rebar holster system designed to accurately place and secure vertical reinforcing bars during concrete masonry wall construction. In preferred embodiments, the vertical reinforcing bars are secured to the horizontal bars after concrete masonry units have been properly positioned (i.e., the vertical reinforcing bars are secured "post-wall erection"). However, it should be understood that the reinforcing bars may also be installed using the present rebar holster system pre-wall erection or in-process wall erection as desired. Further, while the individual holsters of the rebar holster system described below are believed to be particularly advantageous with respect to dropping vertical reinforcing bars down through vertical cores in a concrete masonry wall prior to filling the cores with grout, it should be understood that the features of the holsters described below can be utilized in any number of methods for positioning reinforcing bars within any type of wall structure with similar advantages such as requiring no tools to secure standard reinforcing bars to the holsters.

Figure 2:
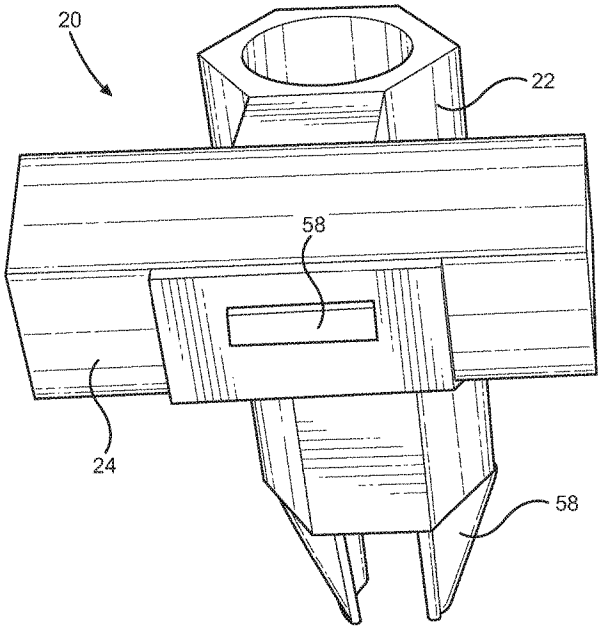
FIG. 2 depicts a vertical/horizontal combination holster according to one embodiment of the disclosure.
Figure 1:
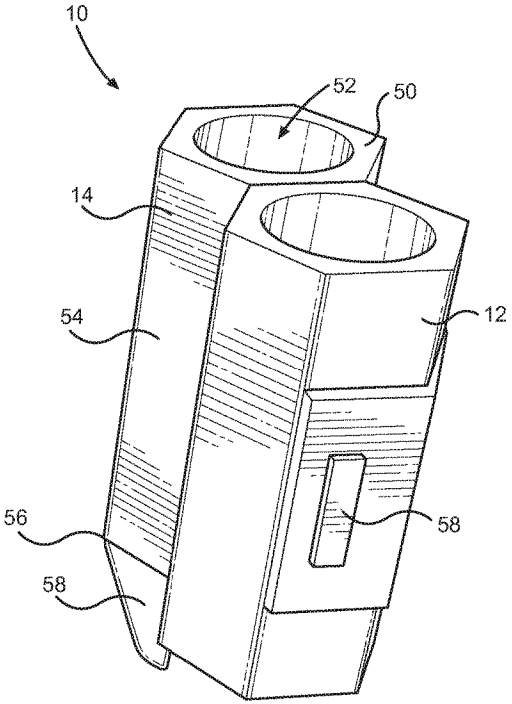
FIG. 1 depicts a footer dowel/vertical combination holster according to one embodiment of the disclosure.
Figure 3:
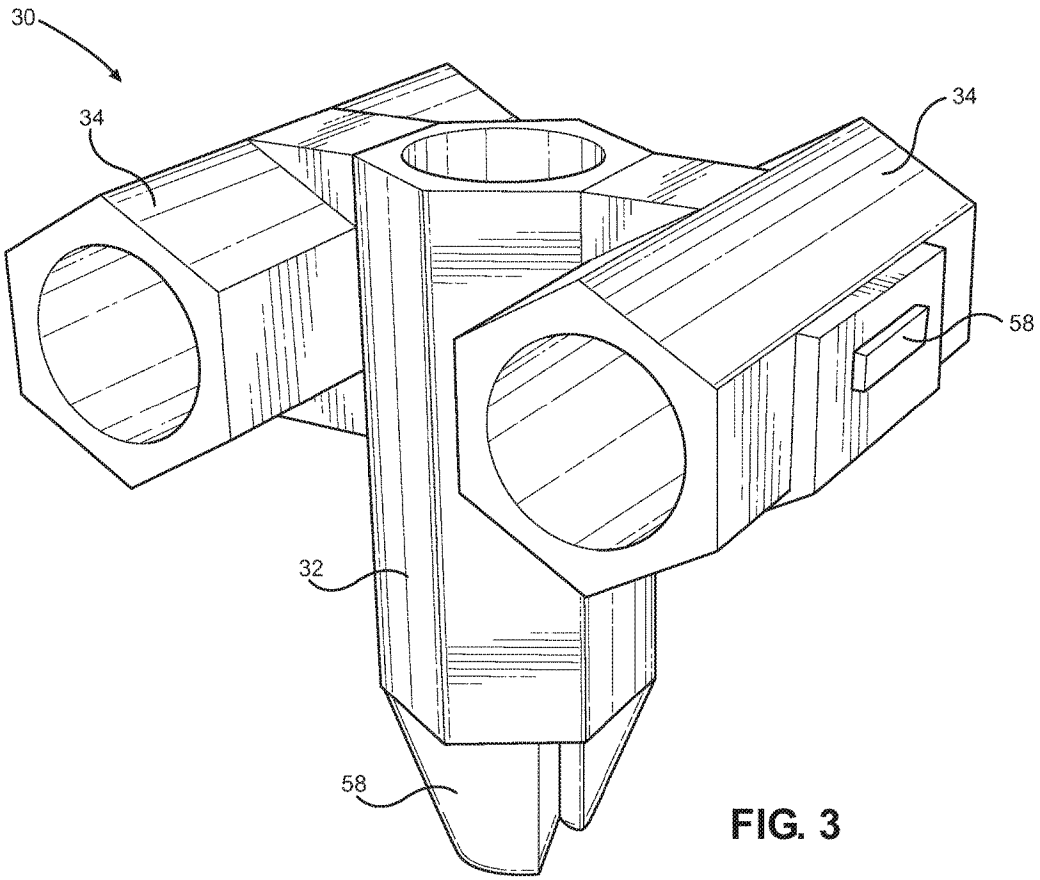
FIG. 3 depicts a vertical/double horizontal combination holster according to one embodiment of the disclosure.

Referring to FIGS. 1-3, the rebar holster system of the present disclosure generally includes three primary holster combinations: 1) a footer dowel/vertical combination holster 10; 2) a vertical/horizontal combination holster 20; and a vertical/double horizontal combination holster 30. As shown in FIG. 1, the footer dowel/vertical combination holster 10 includes a footer dowel holster 12 and a vertical holster 14. As shown in FIG. 2, the vertical/horizontal combination holster 20 includes a vertical holster 22 (preferably similarly configured to vertical holster 14) and a horizontal holster 24. As shown in FIG. 3, the vertical/double horizontal combination holster 30 includes a vertical holster 32 (preferably similarly configured to vertical holsters 14 and 22), a first horizontal holster 34, and second horizontal holster 36 (horizontal holsters 34 and 36 preferably similarly configured to horizontal holster 24). As shown, each of the holsters includes a securing means 58 for securing the holster to one of a vertical reinforcing bar 40, a horizontal reinforcing bar 46, and a footer dowel 16 depending on the appropriate connection needed. It should be understood that other combination holster variations are possible and within the scope of the present disclosure depending on how the holsters are being used and the preferred method of positioning the system of reinforcing bars within a wall structure (e.g., the footer dowel holster 12 of combination holster 10 could further include a horizontal holster if a horizontal reinforcing bar is desired at the base portion, the vertical/horizontal combination holster 20 could further include another vertical holster in addition to vertical holster 22 and horizontal holster 24 if it is desired to connect the combination holster 20 to a second vertical reinforcing bar such as for taller walls, etc.).

As noted above, each of the holster combinations 10, 20, and 30 preferably include a similarly configured vertical holster. Referring to FIG. 1 and exemplified by vertical holster 14, each vertical holster preferably includes an upper portion 50 having an opening 52, a middle portion 54, and a lower portion 56 having the vertical holster securing means 58 adjacent the lower portion 56. An aperture runs through the interior of the vertical holster from the opening 52 to the securing means 58 (or entirely through the securing means 58 such as when the securing means is a washer or other friction engaging mechanism according to the embodiment described below and exemplified in the present figures).

Figure 4:
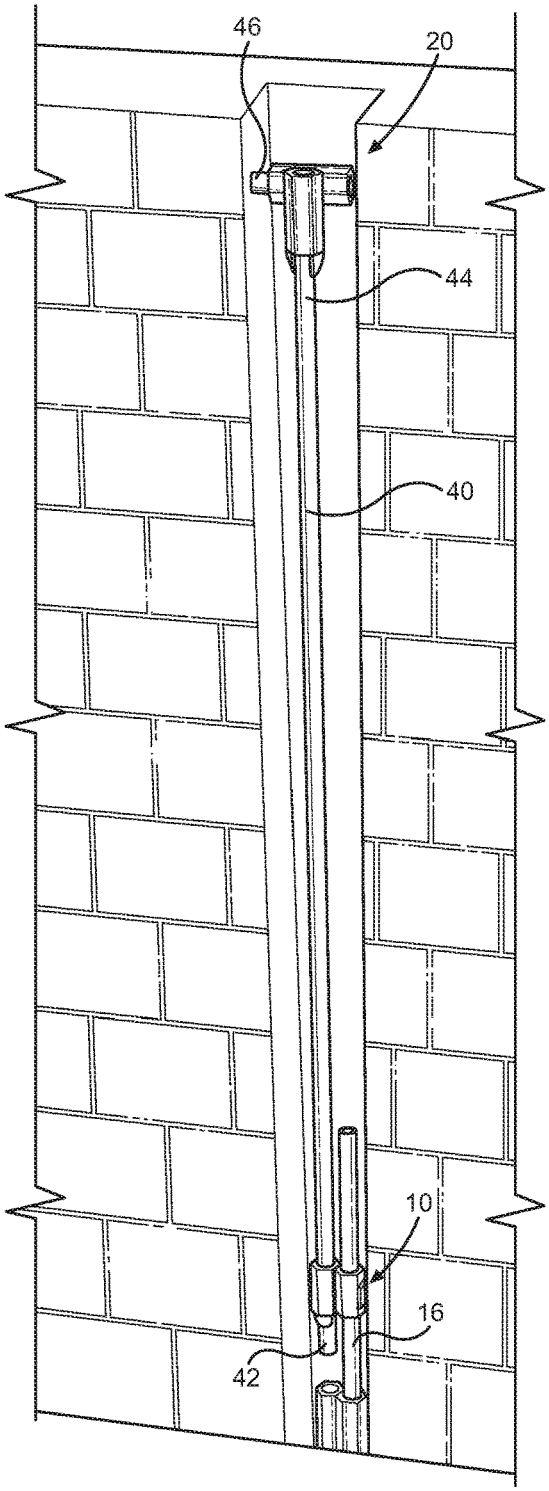
FIG. 4 depicts a vertical reinforcing bar as secured at its leading end to a footer dowel/vertical combination holster and at its trailing end to a vertical/horizontal combination holster within a cut-out portion of a concrete masonry wall according to one embodiment of the disclosure.
Figure 4A:
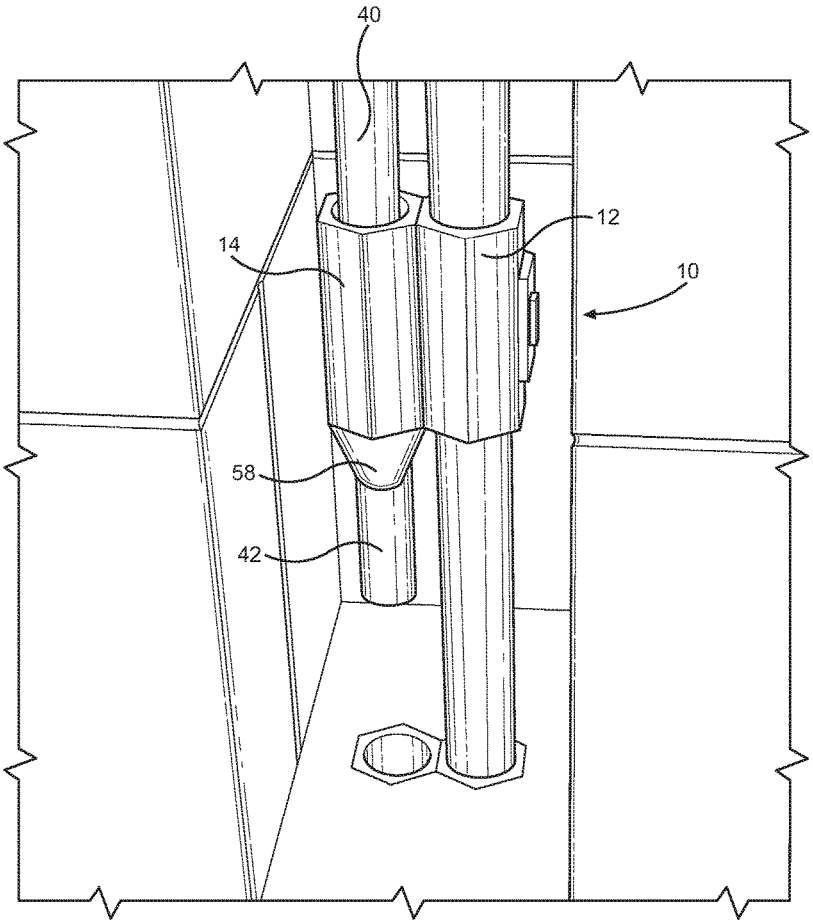
FIG. 4A depicts an enlarged view of a vertical reinforcing bar secured at its leading end to a footer dowel/vertical combination holster according to one embodiment of the disclosure.

In preferred methods of using the present rebar holster system to form a concrete masonry wall, a base portion of the masonry wall is first constructed. Referring to FIGS. 4 and 4A, the footer dowel/vertical combination holster 10 is positioned and secured within the base portion by connecting the footer dowel holster 12 to a footer dowel 16. Concrete masonry units are then stacked above the base portion to form a vertical core within the concrete masonry units such that the vertical core is aligned with the vertical holster 14. A vertical reinforcing bar 40 is then lowered through the vertical core and secured to the vertical holster 14.

According to one aspect of the present disclosure, the vertical holsters 14 are preferably dimensioned and configured to assist in receiving and securing a leading end 42 of the vertical reinforcing bar 40 when dropped down through a vertical core formed in masonry units stacked above the vertical holster 14. In this regard, the diameter of the opening 52 in the upper portion 50 of the vertical holster is preferably larger than the diameter of the leading end 42 of the vertical reinforcing bar 40. In other words, the upper portion 50 of a vertical holster is able to "loosely" receive the leading end 42 of the vertical reinforcing bar 40 as compared to the securing of the leading end 42 by the securing means 58. In addition, a larger opening 52 at the upper portion 50 helps a user to initially locate the vertical holster when a vertical reinforcing bar is being dropped down through a vertical core. A fluorescent marking may also be provided adjacent the opening 52 for assisting in locating opening 52 in the vertical core. Once the leading end 42 is received by the upper portion 50, the middle portion 54 of the vertical holster 14 is able to guide the leading end 42 towards the securing means 58 of the lower portion 56 of the vertical holster 14.

The securing means 58 may take many forms in accordance with the present disclosure. In this regard, it is noted that grout will typically be poured into and fill a vertical core after the concrete masonry units are stacked and the reinforcing bars are properly positioned. Thus, at least according to most embodiments, it is only necessary that the securing means 58 is sufficient to hold the vertical reinforcing bar 40 in place until grout is poured into the vertical core.

Accordingly, in preferred embodiments, the securing means 58 of vertical holster 14 includes a friction engaging mechanism sufficient to hold the leading end 42 of the vertical reinforcing bar 40 within the vertical holster 14 as shown best in FIG. 4A. For example, the friction engaging mechanism could include a washer formed of a resilient material (e.g., vulcanized rubber or a rubber-like material such as neoprene) that presses tightly against the leading end 42 of the vertical reinforcing bar 40 when the leading end is inserted into or otherwise through the securing means 58. More specifically, according to most preferred embodiments, the friction engaging mechanism is a washer formed of a resilient material where the washer includes an aperture (i.e., any type of opening through the washer even if the washer does not form a complete circle as depicted in the exemplary embodiment of the FIGS. 1-3) having a diameter substantially the same or smaller than the diameter of the leading end 42 of the vertical reinforcing bar 40. Thus, when the leading end 42 is guided into the aperture by the middle portion 54 of vertical holster 14, the aperture expands to press tightly against the leading end 42 of the vertical reinforcing bar 40.

As noted above, the vertical holsters 14 are preferably dimensioned and configured to assist in receiving and securing a leading end 42 of the vertical reinforcing bar 40 when dropped down through a vertical core formed in masonry units stacked above the vertical holster 14. Thus, according to certain embodiments, the aperture that runs through the interior of the vertical holster from the opening 52 to the securing means 58 may be gradually sloped from a larger diameter at the opening 52 of the upper portion 50 to an increasingly smaller diameter at the securing means 58 (i.e., "funnel-shaped" interior). Further, in certain embodiments, the securing means 58 itself can be funnel-shaped. For example, as noted above, the securing means could include a washer formed of a resilient material with an aperture (that is aligned with the opening 52 though preferably having a smaller diameter than opening 52) where the washer aperture itself includes an upper portion having a greater diameter than the lower portion of the washer aperture. Thus, according to this embodiment, the washer is configured to press-fit against the leading end 42 of vertical reinforcing bar 40 in a gradually tighter manner the further the leading end 42 is pushed through the washer aperture.

According to alternate embodiments, the securing means 58 of the vertical holsters and/or leading end 42 of the vertical reinforcing bar 40 could include various other types of attachment mechanisms including, but not limited to, threads (e.g., an internally threaded washer for securing to the leading end 42 of a vertical reinforcing bar 40 that includes matching threads), deflectable tabs and receivers (e.g., one or more deflectable tabs on the leading end 42 of a vertical reinforcing bar configured to engage corresponding receivers in the holster), etc. However, a friction engaging mechanism that permits the securing means 58 to receive a standard reinforcing bar without modification to the reinforcing bar as described above is preferred. Further, it should be understood that securing means 58 may be disposed entirely within a holster or, as represented in the figures, extending from the bottom of the holster.

Figure 4B:
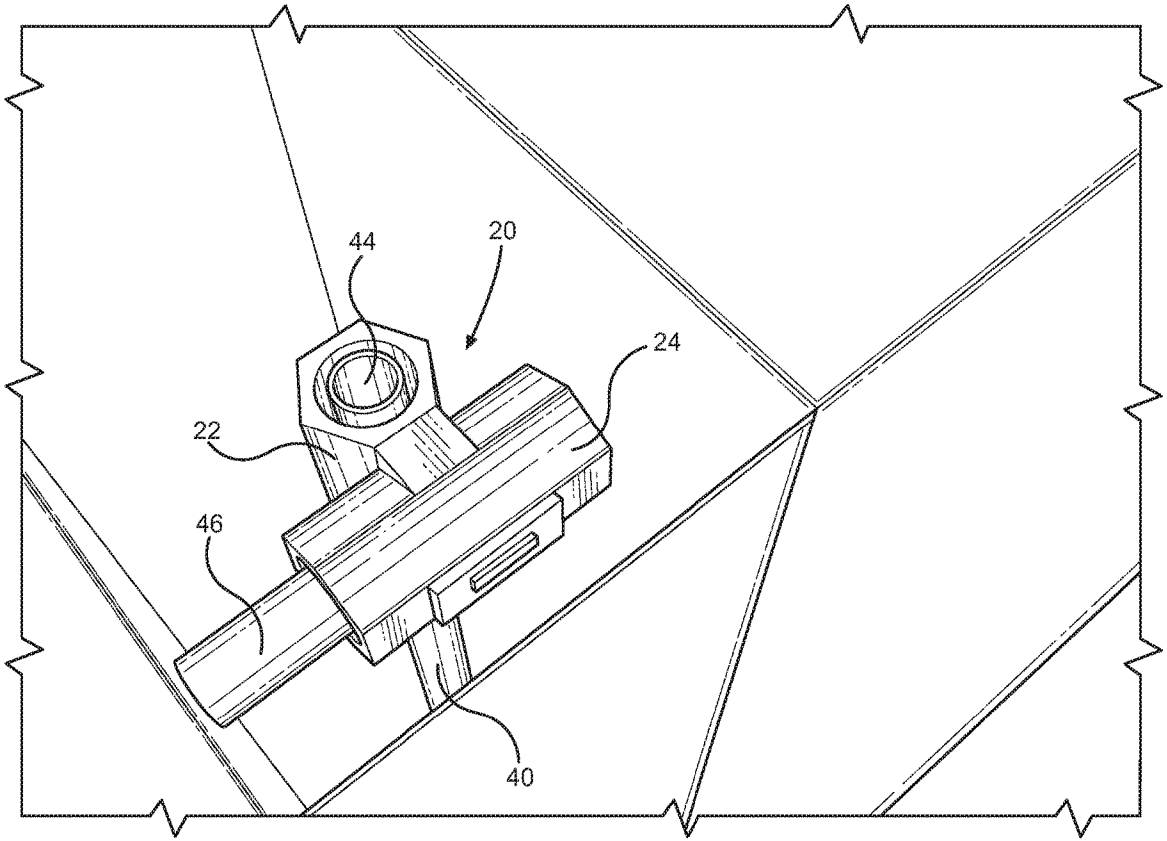
FIG. 4B depicts an overhead view of a vertical reinforcing bar secured at its trailing end to a vertical/horizontal combination holster according to one embodiment of the disclosure.
Figure 5:
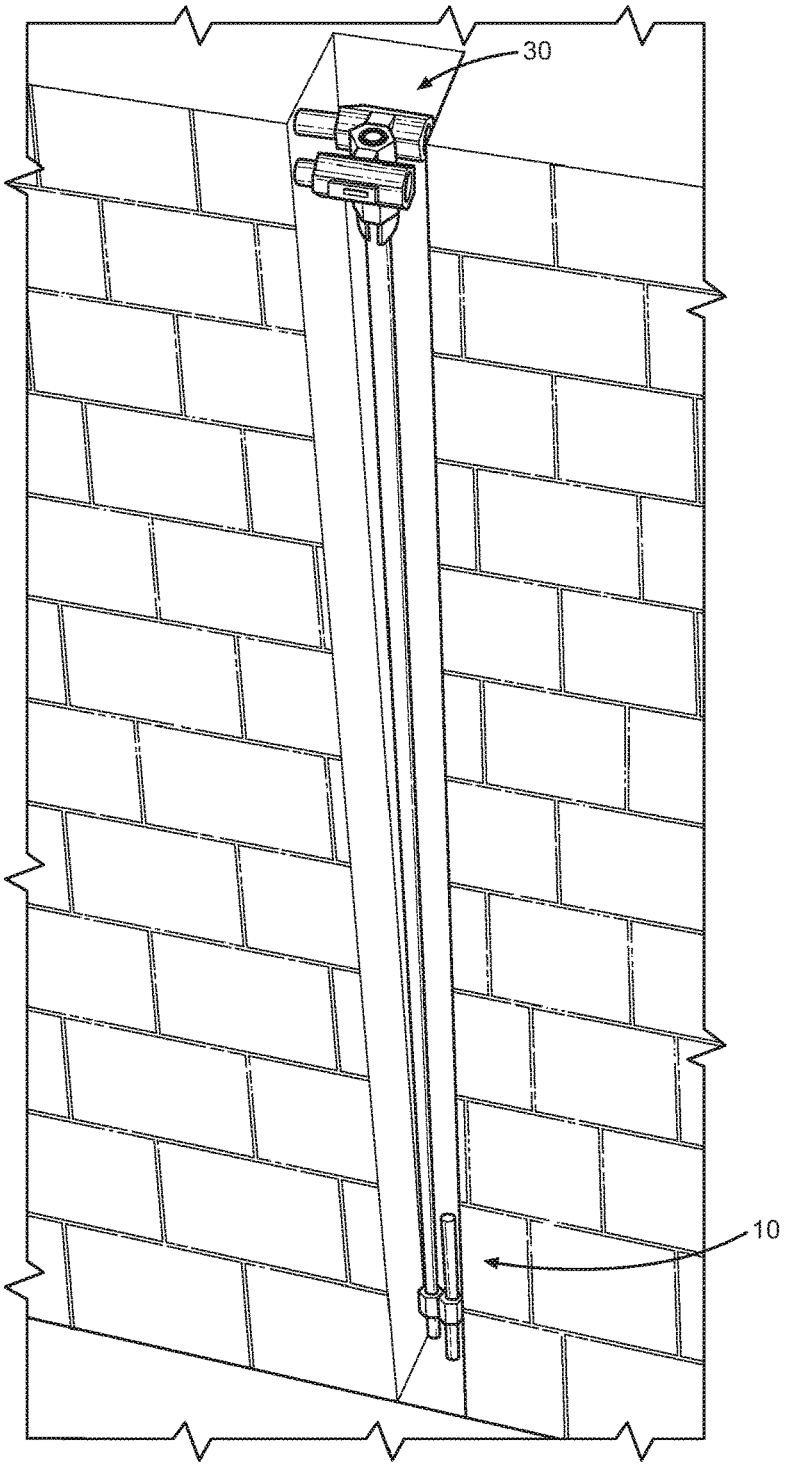
FIG. 5 depicts a vertical reinforcing bar as secured at its leading end to a footer dowel/vertical combination holster and at its trailing end to a vertical/double horizontal combination holster within a cut-out portion of a concrete masonry wall according to one embodiment of the disclosure.
Figure 5A:
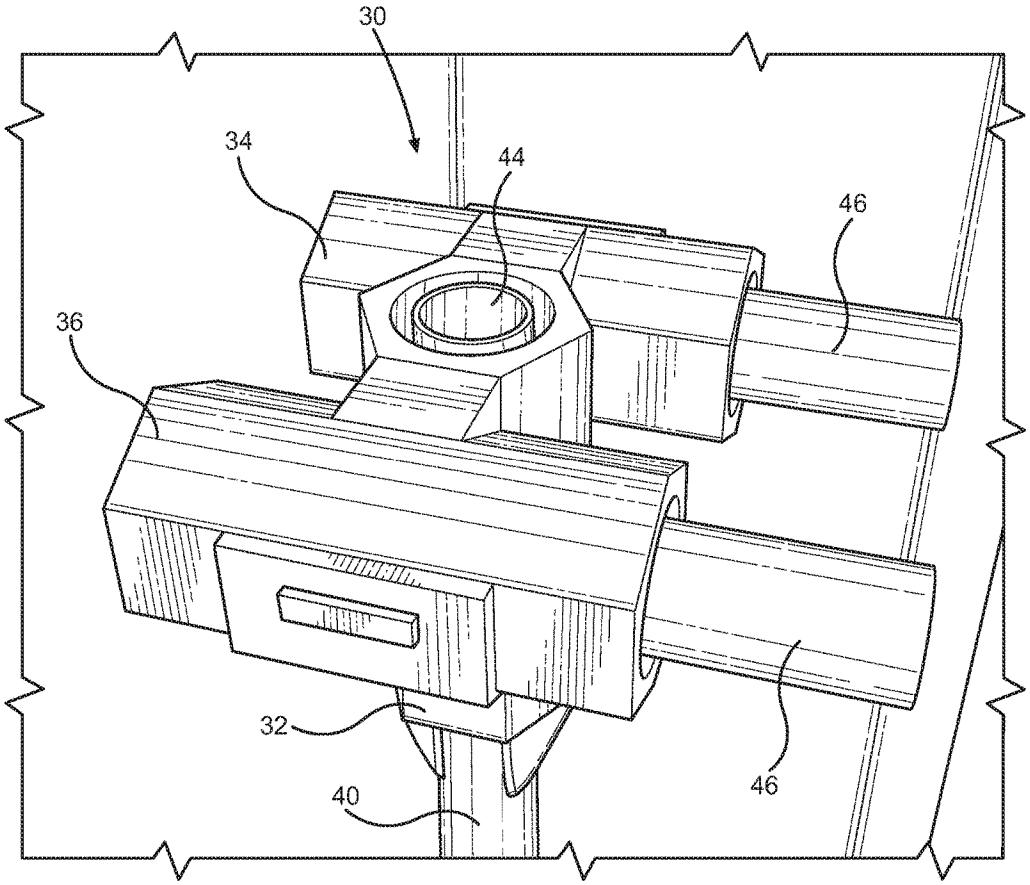
FIG. 5A depicts an enlarged view of a vertical reinforcing bar secured at its trailing end to a vertical/double horizontal combination holster according to one embodiment of the disclosure.

Referring now to FIGS. 4, 4B, 5 and 5A, preferably after the leading end 42 of the vertical reinforcing bar 40 is secured to vertical holster 14, another vertical holster, such as the vertical holster 22 of a vertical/horizontal combination holster 20 (as depicted in FIGS. 4 and 4B) or the vertical holster 32 of a vertical/double horizontal combination holster 30 (as depicted in FIGS. 5 and 5A), is secured to a trailing end 44 of the vertical reinforcing bar 40. The vertical holster for securing to the trailing end 44 of the vertical reinforcing bar preferably includes a similar securing means as described above with respect to securing means 58 of vertical holster 14. However, because the trailing end 44 of the vertical reinforcing bar 40 does not have to be dropped down into a core, it is not as critical to include the guide features described above for guiding the reinforcing bar towards the securing means. In other words, because a user will be able to directly access the point where the trailing end of the vertical reinforcing bar is connected to a vertical holster, the guiding features described above for vertical holster 14 is not as critical for vertical holsters 22 and 32. Further, it should be understood that the securing means for securing to the trailing end 44 may be positioned at the top or bottom of the vertical holster 22 and 32.

Referring still to FIGS. 4, 4B, 5 and 5A, the trailing end 44 of the vertical reinforcing bar 40 is preferably secured to a combination holster that includes at least one horizontal holster for connecting one or more horizontal reinforcing bars 46 to the vertical reinforcing bar 40. For example, as shown in FIGS. 4 and 4B, the combination holster 20 includes one horizontal holster 24 for connecting to one horizontal reinforcing bar 46. As shown in FIGS. 5 and 5A, the combination holster 30 includes two horizontal holsters 34, 36 for connecting to two horizontal reinforcing bars 46. It should be understood that horizontal holsters also include a securing means 58 that could be the same as the securing means 58 of the vertical holsters as described above. However, similar to the securing means of the vertical holster for connecting to the trailing end 44 of the vertical reinforcing bar 40, it is not as critical to include the guide features described above in the horizontal holsters because a user will be able to directly access the horizontal holster when connecting it to a horizontal reinforcing bar 46. As represented in the figures, one type of securing means 58 for the horizontal holsters is a type of spring-loaded snap-lock type mechanism that allows a user to push an exterior "button" to disengage the horizontal holster from the horizontal reinforcing bar. In preferred embodiments, the snap-lock mechanism automatically engages the horizontal reinforcing bar 46 when inserted into the horizontal holster.

In preferred uses of the present rebar holster system, a plurality of footer dowel/vertical combination holsters 10 are secured to footer dowels 16 of wall base portion. Concrete masonry units are then stacked as known in the art on top of the base portion to a height in which horizontal reinforcing bars 46 are desired. At this point, vertical reinforcing bars 40 are dropped through the vertical cores of the concrete masonry units and each secured at the leading end 42 of the vertical reinforcing bar 40 to the vertical holster 14 of combination holster 10. The trailing end 44 of the vertical reinforcing bar 40 is then secured to the vertical holster 22 of a combination holster 20 or 32 of combination holster 30 depending on how many horizontal reinforcing bars 46 are desired. Once the vertical reinforcing bars 40 are secured to their respective vertical holsters 14 and the horizontal reinforcing bars 46 are secured to their respective horizontal holsters, grout is poured into the vertical cores. Successive wall portions (i.e., buildings with multiple stories) could then be built on top of the wall using a similar procedure where another footer dowel is then placed into a higher base portion of the wall structure and the procedure is started over.

The foregoing description of preferred embodiments for this disclosure have been presented for purposes of illustration and description. They are not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

The invention claimed is:

1. A method of installing a vertical reinforcing bar in a masonry wall, the method comprising:

constructing a base portion of the masonry wall;

positioning a vertical holster within the base portion, the vertical holster comprising an upper portion having an opening and a lower portion having a securing means, the opening of the upper portion having a greater diameter than the vertical reinforcing bar such that the upper portion is dimensioned and configured for loosely receiving a leading end of the vertical reinforcing bar;

stacking construction units above the base portion to form a vertical core within the construction units that is aligned with the vertical holster; and lowering the vertical reinforcing bar through the vertical core and the opening of the upper portion of the vertical holster until the leading end of the vertical reinforcing bar is secured to the securing means of the lower portion of the vertical holster.

2. The method of claim 1 wherein the securing means includes a friction engaging mechanism sufficient to hold the leading end of the vertical reinforcing bar in position within the vertical holster until a concrete mixture is poured into the vertical core.

3. The method of claim 2 wherein the friction engaging mechanism includes a washer formed of a resilient material, the washer including an aperture having a diameter substantially the same or smaller than a diameter of the leading end of the vertical reinforcing bar.

4. The method of claim 2 wherein the friction engaging mechanism includes a washer formed of a resilient material, the washer including an aperture having an upper portion with a first diameter and a lower portion with a second diameter, the first diameter being greater than the second diameter and at least the second diameter being substantially the same or smaller than a diameter of the leading end of the vertical reinforcing bar.

5. The method of claim 1 wherein the vertical holster includes a middle portion disposed between the upper portion and lower portion, the greater diameter of the opening extending through the upper portion and the middle portion for loosely receiving the leading end of the vertical reinforcing bar and guiding the leading end of the vertical reinforcing bar from the upper portion and through the middle portion to the securing means of the lower portion.

6. The method of claim 5 wherein the middle portion includes a diameter that is less than a diameter of the upper portion.

7. The method of claim 1 wherein the vertical holster includes an aperture extending from the upper portion to the securing means of the lower portion, the aperture including a first diameter adjacent the upper portion that is greater than a diameter of the leading end of the vertical reinforcing bar and a second diameter adjacent the lower portion that is substantially the same or smaller than a diameter of the leading end of the vertical reinforcing bar.

8. The method of claim 1 wherein the vertical holster includes an aperture extending from the upper portion to the securing means of the lower portion, the aperture having a diameter adjacent the upper portion that is greater than a diameter of the leading end of the vertical reinforcing bar.

9. The method of claim 1 wherein the positioning step includes positioning a combination holster within the base portion, the combination holster including the vertical holster and at least one horizontal holster adjacent the vertical holster, the method further comprising securing a horizontal reinforcing bar to the horizontal holster prior to stacking construction units above the base portion and lowering the vertical reinforcing bar through the vertical core formed by the stacked construction units.

10. The method of claim 1 further comprising:

securing a combination holster to a trailing end of the vertical reinforcing bar, the combination holster including a second vertical holster for receiving the trailing end of the vertical reinforcing bar and at least one horizontal holster adjacent the second vertical holster;

securing a horizontal reinforcing bar to the horizontal holster of the combination holster after stacking construction units above the base portion and lowering the vertical reinforcing bar through the vertical core formed by the stacked construction units; and pouring a concrete mixture into the vertical core.

11. The method of claim 1 wherein the step of positioning the vertical holster within the base portion of the masonry wall includes securing the vertical holster to a footer dowel prior to stacking construction units above the base portion.

* * * * *